US005194012A

United States Patent [19]

Cairns

[11] Patent Number: 5,194,012

[45] Date of Patent: Mar. 16, 1993

[54] SPARK-PROOF HOSTILE ENVIRONMENT CONNECTOR

[76] Inventor: James L. Cairns, 1689 State Ave., Holly Hill, Fla. 32017

[21] Appl. No.: 737,710

[22] Filed: Jul. 30, 1991

[51] Int. Cl.[5] ..... H01R 4/60

[52] U.S. Cl. ..... 439/201; 439/271; 439/693

[58] Field of Search ..... 439/190, 191, 200, 201, 439/207, 208, 204, 206, 271, 277, 283, 693, 936

[56] References Cited

U.S. PATENT DOCUMENTS

| | | | |
|---|---|---|---|
| 2,443,513 | 6/1948 | Quackenbush | 439/936 X |
| 3,643,207 | 2/1972 | Cairns | 439/201 |
| 4,696,540 | 9/1987 | Adams et al. | 439/201 X |
| 4,795,359 | 1/1989 | Alcock et al. | 439/201 X |
| 4,948,377 | 8/1990 | Cairns | 439/201 X |

FOREIGN PATENT DOCUMENTS

| | | | |
|---|---|---|---|
| 0244657 | 11/1987 | European Pat. Off. | 439/936 |
| 0674132 | 7/1979 | U.S.S.R. | 439/190 |
| 0792381 | 12/1980 | U.S.S.R. | 439/190 |

*Primary Examiner*—Larry I. Schwartz
*Assistant Examiner*—Khiem Nguyen
*Attorney, Agent, or Firm*—Brown, Martin Haller & McClain

[57] ABSTRACT

An electrical connector has a female portion with tubular socket assemblies extending into it that are coated with a thin dielectric film over their surfaces with the exception of their internal electrical contact bands. The socket assemblies and the interior of the female portion are immersed in a dielectric fluid, the pressure which is equalized to that of the surrounding environment. Spring-biased pistons are located within openings in resilient seals at the open ends of the socket assemblies to seal the interior of the socket assemblies against the environment. When the portions are mated, pins on the male portion are wiped by the resilient seals and depress the pistons past the contact bands as they enter the socket assemblies. The pins are also coated with the dielectric film with the exception of thier conductive tips, which contact the contact bands. The thin dielectric coating allows the connector to be reduced in size.

16 Claims, 3 Drawing Sheets

SPARK-PROOF HOSTILE ENVIRONMENT CONNECTOR

BACKGROUND OF THE INVENTION

There are now many types of electrical connectors for use in hostile environments. One category includes connectors intended for subsea mating and demating. And as a sub-category of these, there are connectors that are fluid-filled and pressure-balanced. The present invention, although not intended specifically for subsea use, falls within the scope of connectors of the last type.

One such connector is described by Buck, U.S. Pat. No. 3,508,188, wherein the connector receptacle sockets are housed in a fluid-filled chamber. In its simplest form the chamber has a sealed opening through which a male probe enters, said opening sealing against the shaft of the male probe in the mated condition. In the unmated condition, the opening seals against the elongate section of a piston contained within the receptacle socket assembly, and resiliently biased outwardly so as to follow the male probe into the opening as the probe is withdrawn. The opening is always sealed, therefore, either by being filled with the piston or with the male probe.

There are now many other subsea connector designs of the general sort proposed by Buck in the aforementioned patent, some of which are described by Briggs, U.S. Pat. No. 3,729,699; Butler, U.S. Pat. No. 4,142,770; Alcock, U.S. Pat. No. 4,795,359; Cairns, U.S. Pat. No. 4,948,337; Wilson, U.S. Pat. No. 4,039,242, and others.

The intention of these sealed fluid-filled connectors is to protect the electrical junctions from the outside environment by enclosing them within a chamber of benign non-conductive mobile dielectric substance such as oil, gel or grease (hereinafter referred to simply as oil or fluid), from which seawater is excluded. And such connectors do protect the junctions from the environment very well. There is a useful byproduct of this construction; these connectors are also spark-proof. If designed properly, they can be mated and demated with the receptacle sockets electrically energized. As the tip of the male probe approaches the energized socket, some arcing does take place, as it does any time a switch is thrown in an energized circuit But this arcing is contained within the oil-filled chamber and is partially suppressed by the oil. As a result, these connectors could be used in volatile atmospheres without danger of spark-induced explosions.

All of the aforementioned connectors are relatively large, being designed for the most part to be used in subsea systems where size is not a driving factor. The most reliable ones employ internal walls with elastomeric elements to define separate fluid-filled compartments around each circuit for redundant environmental protection. And they employ a relatively thick dielectric sleeve around the shank of each plug probe for the same reason. These elements contribute to the overall size.

There are demands for small, high circuit-density hostile-environment connectors which the above mentioned products cannot meet because of their size. These applications are not only in modern underwater sensor and control systems, but in medical, mining, petrochemical processing and other fields where harsh or explosive environments are encountered.

A goal of the present invention, therefore, is to provide a connector of the general sort just described, with redundant environmental and electrical barriers, but which is small enough so that it can be employed in a wide range of uses including spark-proof explosive-environment applications.

The invention laid out in the description to follow advances fluid-filled connector technology by substantially reducing the size of such connectors, leading to the possibility of packing a relatively large number of circuits in a confined space, while at the same time enhancing the isolation of the circuitry from the outside environment. It provides a pin and socket connector with redundant electrical and environmental protective barriers. In addition, the present invention provides an electrical connector with improved plug-probe and receptacle seal designs that contribute to miniaturization.

SUMMARY OF THE INVENTION

The invention is based on the realization that some of the electrical and environmental barriers, consisting of interior walls currently used in fluid-filled, pressure balanced subsea electrical connector receptacles, could be eliminated by using polymeric-film, dielectric, environmental coating. Such coatings can be vapor deposited pinhole free. Coatings as thin as 0.001 inches provide adequate electrical (5000 Volts) and environmental isolation for electrical conductors. The utilization of these coatings to eliminate some of the previously mentioned barriers then relieves constraints on the remaining seals, allowing more latitude in their design. The use of such a thin coating for insulation of all electrical conductive parts, except for the actual electrical contacts, is a major improvement and part of this invention. A coating to be used is in the family polymers based upon poly-p-xylylene, one of which is polymonochloro-para-xylylene.

One of the parameters that has controlled the ultimate size of these previous connectors has been the thickness of the dielectric sleeves on the male probes. Typically epoxy or other plastic material has been used with some provision, such as O-rings or adhesives, to provide mechanical and electrical barriers between the sleeve and the internal conductor. Making these sleeves thin has been impractical for mechanical reason; epoxy, for instance, cracks easily in thin sections. But the deposited polymeric films mentioned are resilient; they flex without cracking. By replacing the sleeves with thin films such as these, the present invention allows considerably smaller diameter male probes for a given current capacity, leading to the miniaturizing of the plug probes.

The invented connector has, then, two main aspects. The first is directed towards a connector receptacle which has an exterior shell within which is disposed a main oil-filled chamber which is pressure compensated to the ambient exterior environment through a resilient element, and which has a plurality of ports opening to the outside environment. A plurality of electrically-conductive socket assemblies is disposed within the main chamber, each in alignment with a respective one of said ports, and a moveable piston assembly is disposed in each of said socket assemblies and including an elongated tip. The piston is moveable between a first position in which the tip protrudes out through the respective port, and a second position in which the tip is retracted from the port. An end-seal means is provided in each respective port for constricting the passageway into a sealing engagement with the elongated piston tip. Each of the plurality of socket assemblies has one or more ventilation holes allowing free flow of the main chamber fluid to every interior part of the socket assembly. Except for the interior tip portion of each respective socket assembly, which actually engages the conductive tip of each respective male probe, the surfaces of each said socket assembly are coated within a thin film dielectric coating that is not detrimentally affected by most corrosive agents, including seawater, and which forms an environmental and electrical barrier between the socket assembly and the fluid of the main chamber. Thus even if the main chamber should be intruded by some seawater, the likelihood of said seawater bridging the gap to form an electrically conductive path between exposed conductive portions of neighboring ones of said socket assemblies is greatly reduced by the thin film barrier.

In the second of its aspects, the invention includes a sealed connector with a receptacle having a receptacle shell, a fluid filled pressure compensated main chamber disposed within the receptacle shell, an end seal assembly for sealably enclosing said main chamber and including a plurality of ports and a means for exerting a radially constrictive force through each of said ports, and a first alignment mechanism. The connector also includes a plug with a plug shell for receiving the receptacle shell, a plurality of electrical probes in the plug shell, each with an exposed conductive tip and a dielectric thin film coated shaft, and each for being inserted into the receptacle through a respective one of the ports and for forming a tight seal with that port, and a second alignment mechanism to align the probes with the ports. The receptacle further includes a plurality of electrical socket assemblies within the main chamber, each of the electrical socket assemblies being in alignment with a respective one of the ports and each including a piston movably disposed in the electrical socket assembly and including an elongate tip. Each of said socket assemblies is pressure balanced to the fluid of the main chamber, and is substantially sealed electrically and environmentally from the fluid of the main chamber by a thin film coating which covers all but the actual socket contract area of the socket assembly. The piston of each electrical socket assembly is moveable by a respective one of the probes from a first position in which the elongate tip protrudes through and forms a seal with a respective one of said ports to a second position in which the tip is retracted into the socket assembly, and said respective port sealably encloses the insulated shaft of said respective plug probe. As the plug and receptacle halves come to full engagement, an elastomeric extension protruding outward from each of said sealed receptacle openings is pressed against the plug face from which said plug probe extends, creating a secondary seal between the engaged electrical contacts and the outside environment.

In the embodiment of the receptacle described thus far, the plurality of socket assemblies is disposed within the main chamber and each of said socket assemblies is contained within the dielectric fluid of said main chamber. And even through the thin film coating on each of said socket assemblies renders the electrical bridging between circuits due to intruded seawater unlikely, it is not impossible.

In a second embodiment of the invented connector an additional measure of protection against such bridging is provided by enclosing the ventilation port to the interior of each of the plurality of socket assemblies within a sleeve which has a resilient element, thereby creating a sealed and separate volume of fluid within each of said socket assemblies. The interior of each respective socket assembly is therefore a sealed and separate oil volume, which is independently pressure compensated to the main chamber fluid pressure, and hence to the ambient exterior pressure, by the resilient element which forms an integral part of each respective sleeve. In the second aspect of the second embodiment, the operation in collaboration with the plug and its probes is identical to that of the first embodiment.

Through the use of thin film coatings and the resulting expanded freedom of seal design, the summarized invention achieves the objective of maintaining redundant environmental barriers for each receptacle socket assembly while at the same time diminishing the size required by previous designs having all-enclosing interior chamber walls surrounding each socket assembly. It further diminishes the size requirements and enhances the reliability by the use of a thin film dielectric coating on the plug probe shafts.

The achievement of these and other objectives and advantages by the invented connector will be understood when the detailed description of the invention, given below, is read with reference to the next summarized illustration, in which:

DESCRIPTION OF THE PREFERRED EMBODIMENT

Figure 1:
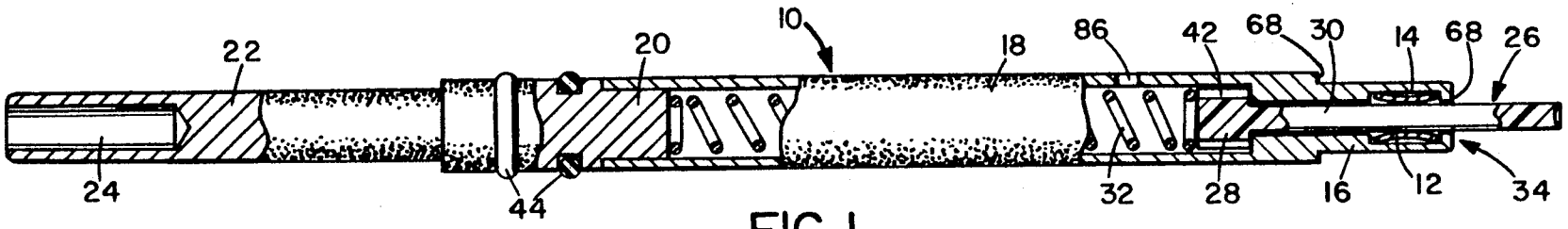
FIG. 1 is a side elevation view, with portions cut away, of the socket connector stem.
Figure 3:
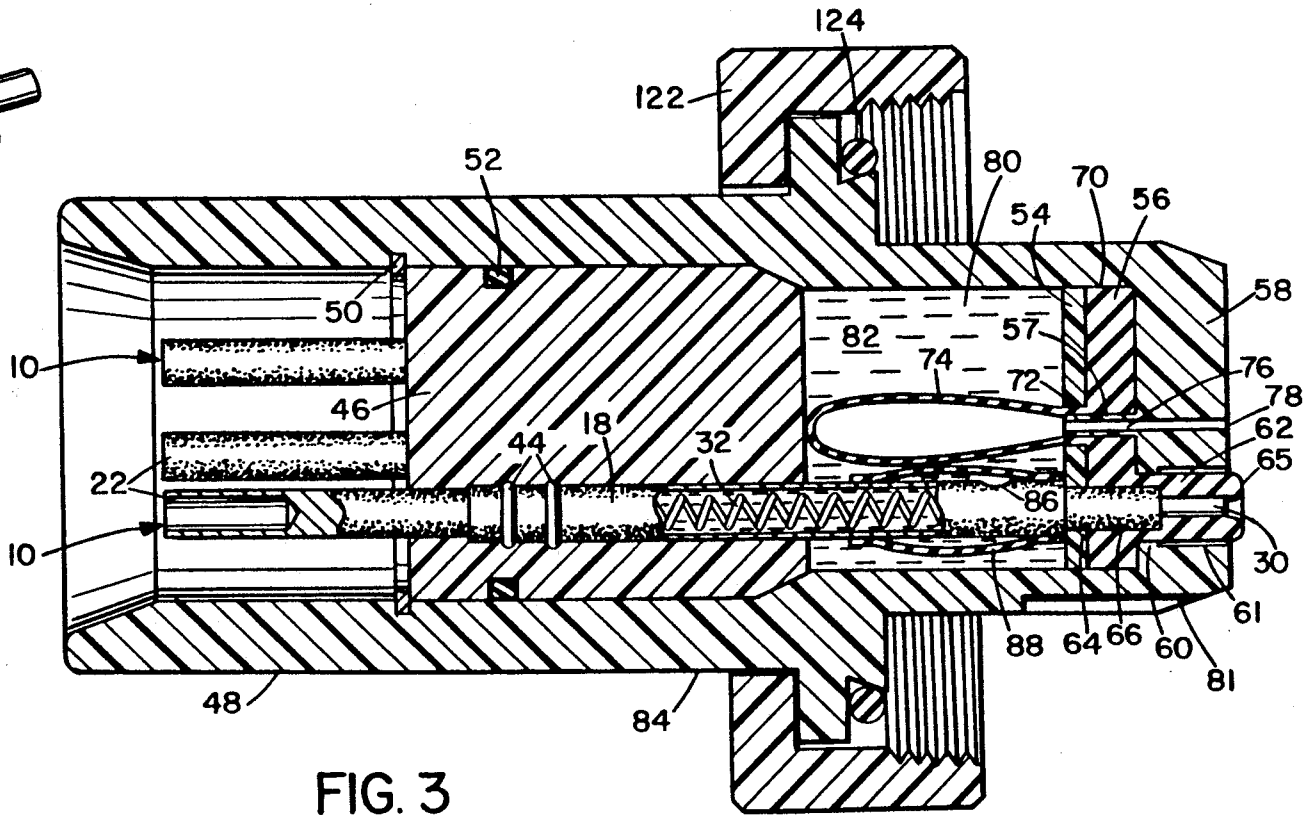
FIG. 3 is a longitudinal sectional view of the complete socket portion of the connector.
Figure 2:
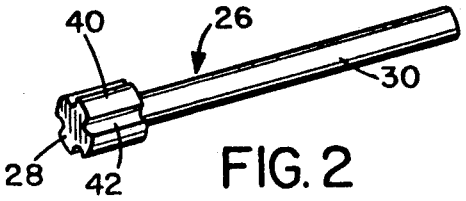
FIG. 2 is a perspective view of the retractable plunger used in the stem.

FIG. 1 illustrates the structure and operation of an electrical socket assembly which is used in the invention. The socket assembly 10 is essentially cylindrical in cross section. It includes in one end, electrical contact band 12 seated in band seat 14. A spring guide tube 18 is mechanically press fit to mating section 20 of solder pot extension 22. The electrical conductive path through the socket assembly goes from the aforementioned contact bands through the contact band seat 14, thence through the spring guide tube 18, and thence through the solder pot extension 22 to the solder pot 24. A piston 26 made of dielectrical material, such as plastic, has a larger end 28 which is rosette in cross-section, and from which protrudes an elongate cylindrical portion 30, see FIG. 2. The piston is captured within spring guide tube 18 by larger end 28 acting against the shoulder formed by smaller diameter section 16 of the contact band seat 14. The rosette form piston end 28 is sized to slidably fit to the inside of the spring guide tube 18, and it allows free flow of fluid past the piston through glands 42 while still keeping the piston axially aligned and centered as it moves back and forth within the tube. Spring 32 is sized to slidably compress and extend within spring guide tube 18. The spring 32 keeps piston 26 biased outward, so that in the absence of other forces, the elongate portion 30 of the piston extends outward through opening 34 of the socket assembly, see FIG. 3.

A plurality of socket assemblies 10 along with O-rings 44 are integrally molded or otherwise suitably contained within dielectric receptacle base 46. This base may be made of any suitable material, such as plastic. O-rings 44 seal the interface between socket assemblies 10 and base 46. Receptacle base 46 is retained within receptacle shell 48, which may be made of plastic, by retainer ring 50. The interface between base 46 and shell 48 is sealed by one or more O-rings 52. An end seal retainer plate 54 captures end seal 56 between plate 54 and the front wall 58 of shell 48. End seal 56, which may be made of rubber, has a plurality of openings 64 which are aligned with and snugly fit to small diameter sections 66 of respective socket assemblies 10. Shoulders 68 of socket assembly 10 keeps the retainer plate 54 pressed firmly against end seal 56, somewhat compressing the end seal to form an effective seal against the inner diameter 70 of shell 48.

A tubular inward extension 57 of end-wall 58 protrudes through end-seal 56 allowing end-seal 56 to be compressed somewhat by retainer plate 54 without closing-off end-seal opening 76. A plurality of holes 60 perforate front wall 58 and are aligned with socket assemblies 10. The forward extension 16 of each of said socket assemblies protrudes into a respective one of the holes 60 in front wall 58 of the receptacle shell 48, thereby rotationally keying the plurality of lip-seals 62 each of which protrudes through respective openings 60, and forms a constrictive seal against the surface of elongated end 30 of respective stopper 26.

Figure 7:
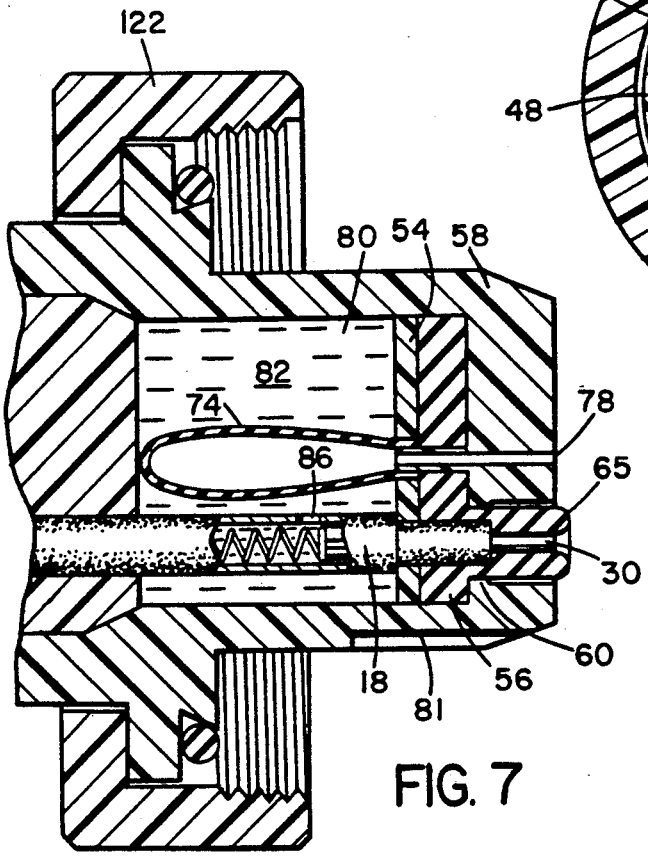
FIG. 7 is a view similar to a portion of FIG. 3, illustrating an alternative stem venting arrangement.

Retainer plate 54 has an additional hole 72 to accommodate bladder 74. Bladder 74 may or may not be formed as an integral part of end-seal 56. The interior of bladder 74 communicates through opening 76 of end-seal 56 and thence through opening 78 of shell end-wall 58 to the outside environment. Bladder 74 in communication with the outside environment causes the fluid 80 within chamber 82 of receptacle 84 to be pressure-balanced with the outside environment. Vent holes 86 in each of the plurality of socket assemblies 10 permit free fluid-flow from the inside to the outside of each of said socket assemblies, thereby pressure balancing the pressure of the fluid inside and outside said assemblies. The entire exterior surface of each of the plurality of socket assemblies 10, and the inside surfaces except for contact band-seat 14 and solder-pot 24 of each said socket assemblies, are coated with the thin dielectric film. This film may have a thickness of about 0.001 inch to 0.005 inch and of a material coating that is pin-hole free. A coating that is a part of this invention is in the family of polymers based upon poly-p-xylylene, one of which is poly-monochloro-para-xylylene. The film reduces the possibility of electrical bridging between respective ones of the plurality of socket assemblies 10, which bridging might occur in the case of an accidental intrusion of seawater into chamber 82. Additional protection against such electrical bridging may be added in the form of resilient-membrane sleeves 88 which sealably enclose ports 86 on all but one of the plurality of socket assemblies 10, see FIG. 7, thereby defining a closed and separate chamber for each of the socket assemblies.

During assembly, these closed and separate chambers are each filled with fluid through their respective ports formed by respective lip-seals 62 of end-seal 56. To fill each of said closed and separate chambers the hypodermic tube of a syringe is inserted through each respective lip-seal 62, thereby forcing stopper 26 inward against spring 32, and entering said respective chamber. The syringe is partially fluid-filled prior to insertion. After insertion, the syringe is first used to withdraw substantially all of the air from said respective chamber. Then said chamber is back-filled with a measured amount of dielectric fluid from the syringe. The one socket assembly not enclosed by a resilient membrane sleeve 88 has the main chamber 82 as part of its closed and separate chamber, and said chamber being filled with dielectric fluid through its respective lip-sealed port in the same way as the rest of the plurality of closed and separate chamber.

Figure 4:
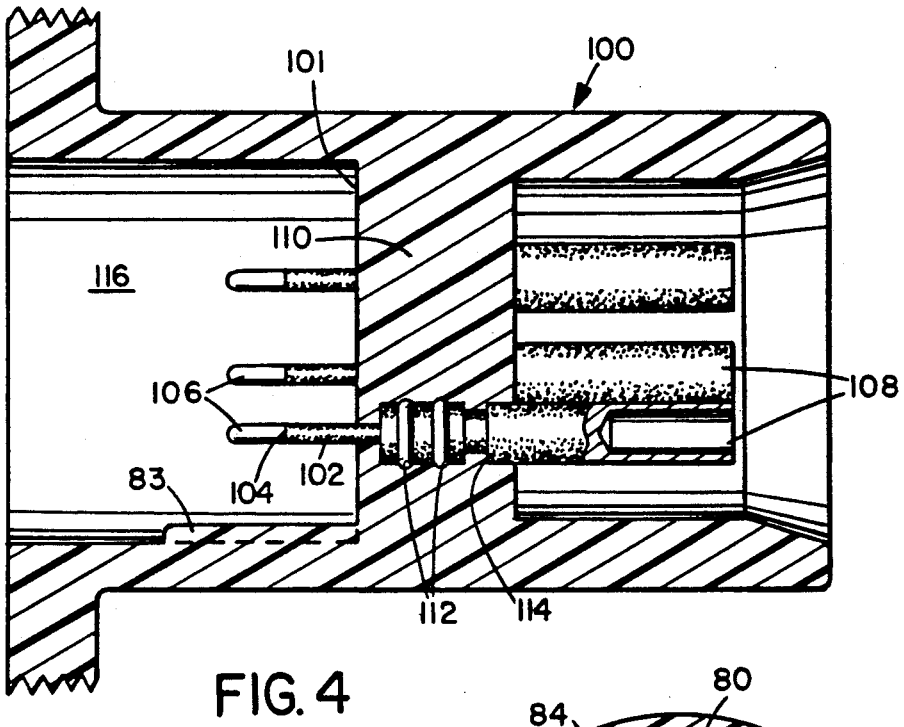
FIG. 4 is a longitudinal sectional view of the plug portion of the connector.

FIG. 4 is a partial cross-sectional view of the mating connector plug 100 showing in partial cross-section one of a plurality of plug probes 104 consisting of a shaft portion 102 with exposed conductive-tip 106 and the remainder of the exterior surface of said probe coated with a thin-film dielectric coating except for the solder-pot 108. Plug probes 104 are integrally molded into solid dielectric plug body 110. The interface between plug probes 104 and plug body 110 is sealed by molded in O-rings 112. Mold grip-rings 114 strengthen the junction between plug probes 104 and plug body 110. The diameter of the probes 104 is larger than the diameter of the elongate tip 30 of the piston 26.

Figure 5:
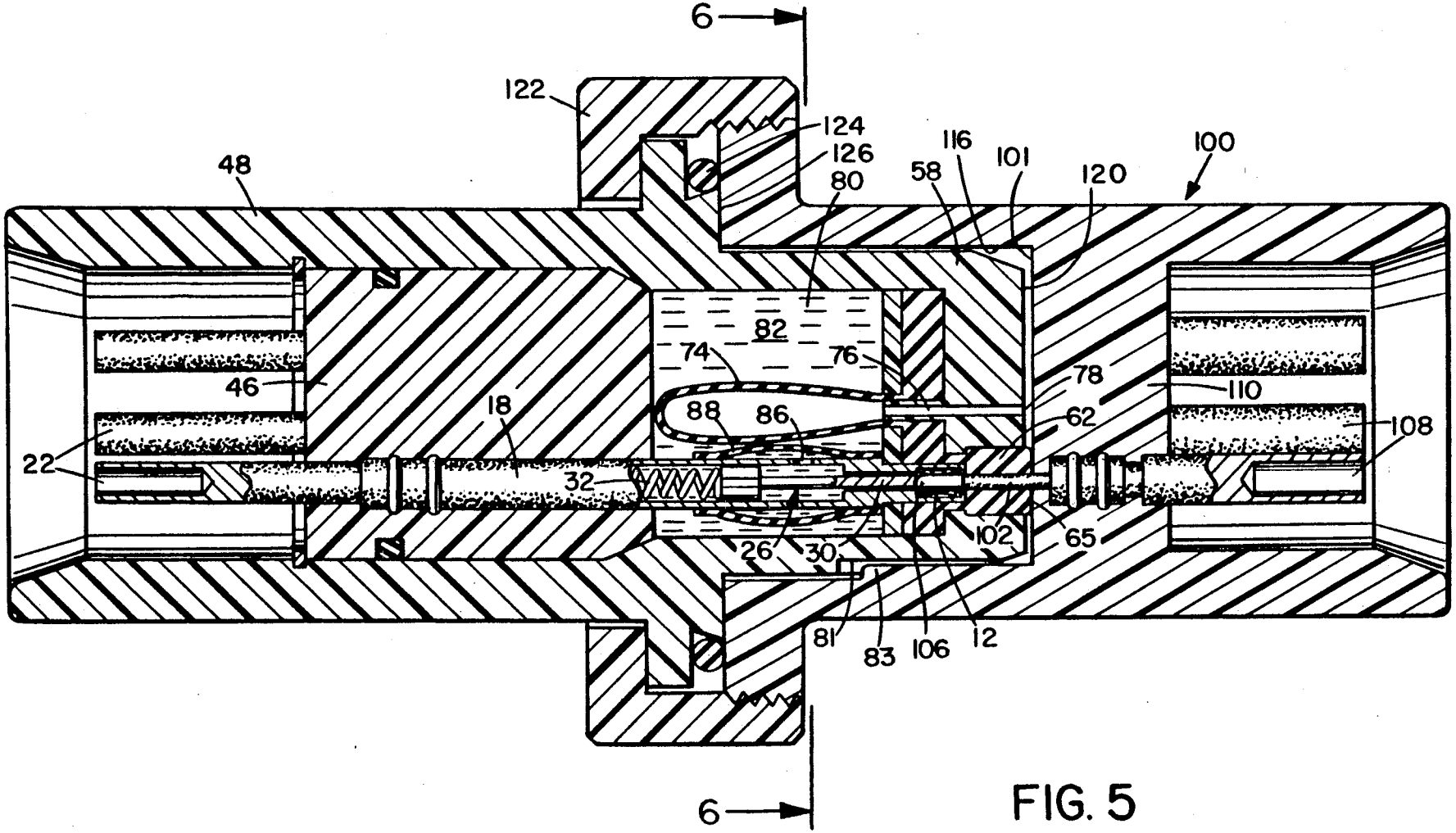
FIG. 5 is a longitudinal sectional view of the assembled connector.
Figure 6:
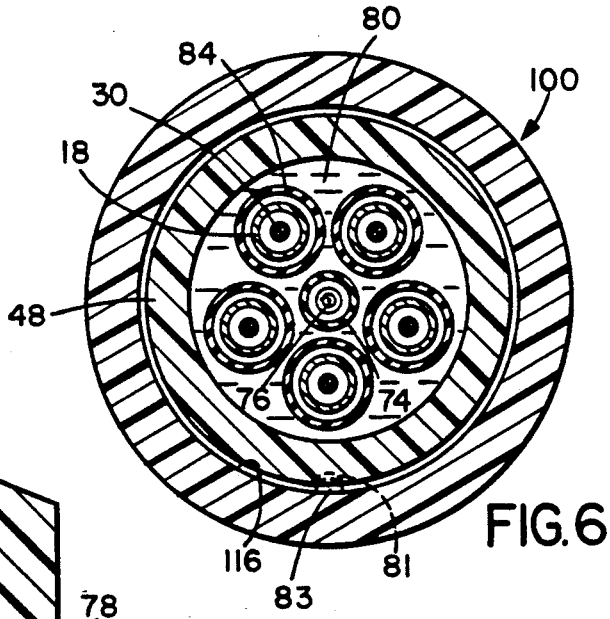
FIG. 6 is a sectional view taken on line 6—6 of FIG. 5.

As the plug and receptacle halves of the connector come together in the mating sequence, see FIG. 5, the receptacle end 58 enters cavity 116 of plug body 100. A key 83 and keyway 81, see FIGS. 3, 5 and 6, maintains the rotational alignment of the mating parts. Each respective plug probe 104 of a plurality of said plug probes enters a respective one of a plurality of lip seals 62 leading into a respective one of a plurality of receptacle socket assemblies 10. As each of said plug probes enter, it pushes the piston or stopper 26 of the respective socket assembly 10 further into said socket assembly simultaneously compressing spring 32 of said socket assembly. Each of the plurality of plug probes 102 enters a respective one of the plurality of socket assemblies 10 engaging each of the plug-probe exposed tips 106 into respective ones of contact bands 12, completing the respective circuits. Lip-seals 62 wipe plug probes 102 clean as the plug probes enter, and form a seal against the coated shafts of each of said respective plug probes. The ends of the plug probes 102 have a substantially larger diameter than that of ends 30. The lip-seals 62 are free to expand radially into larger-diameter portions 61 of each of the respective openings 60 of receptacle end-wall 58. When the connector halves are completely engaged, the portions 65 of lip-seals 62 which protrude from receptacle end-wall 58 are pressed against face 101 of plug 100 thereby forming a secondary environmental seal around the base of each of the respective plug-probes. A space 120 remains between the mating faces of the plug and receptacle, the first surface of the plug and the front end surface of the receptacle, in order to guarantee free communication of external environmental fluid (i.e. seawater) to all exposed portions of the interface, including opening 78 into the receptacle bladder 74. Flexible elements 74 and 88 change shape to accommodate fluid displacement caused by the entering probes. It must be noted that during the normal course of connector operations, some dielectric fluid is lost from the internal receptacle chambers. The individual chambers as well as flexible elements 74 and 88 are sized to permit sufficient fluid loss to achieve the design lifetime of the connectors. Lock-ring 122 keeps the connector halves tightly together.

O-ring 124 is used for special applications. For most projected applications, O-ring 124 is absent, allowing gas or fluid flow across interface 126 and into space 120. This flow allows the interior of the connector to remain in equilibrium with changing exterior ambient pressure. If the interior connector pressure is not somehow balanced to the exterior pressure, when ambient pressure increases dramatically the connector halves are rendered inseparable. Balancing the pressure throughout, therefore allows the connector to be mated and de-mated at any pressure (ocean depth). There are some applications, however in which the connectors need to be mated and de-mated only in splash zones or at modest water depths. An example would be in use as outboard connectors on a military submarine hull where these connectors would see mating and de-mating only at the depth of their position on the submarine hull when it is at dockside. Addition of O-ring 124 would allow the connectors to be mated and de-mated at these modest depths, but would protect the connectors from damage due to high impulsive pressures, such as might occur from a nearby explosion due to a torpedo or depth charge.

I claim:

1. In an electrical connection assembly, a male connector comprising probes that project from a first surface, a female connector comprising a front end surface with openings through said surface, sockets connected to said openings to receive said probes, each said socket having a conductive contact, each said socket, except for said conductive contact, being coated with a polymer based upon poly-p-xylylene, said coating being free of pin-holes and having a thickness of about 0.001 to 0.005 of an inch, means that move said first surface toward said front end surface, moving said probes into said sockets to make electrical connections, resilient seals for sealing said openings through said front end surface around said probes, and said resilient seals having end tips that protrude out of said openings to contact said first surface enclosing and sealing the outer surface of said probes.

2. In an electrical connector assembly as claimed in claim 1 wherein, a piston with an elongated tip positioned in each of said sockets being movable between a first position in which the tips extend into and form seals in said resilient seals and to a second position in which said tips are retracted into the sockets by the probes moving into said sockets.

3. In an electrical connector assembly as claimed in claim 2 wherein said coating comprises a vapor deposited coating of poly-monochloro-para-xylylyene.

4. In an electrical connector assembly, a male connector comprising probes that project from a first surface, with each probe having a conductive end, a female connector comprising enclosed sockets with open ends for containing conductive contacts, and to receive said probes for making electrical connections with said contacts, each said socket, except for said conductive contacts, being coated with a polymer based upon poly-p-xylylene, said coating being free of pin-holes and having a thickness of about 0.001 to 0.005 of an inch, and resilient seals positioned in said open ends and projecting out from said open ends for encircling ones of said probes, sealing the surfaces of said probes that are outside said sockets.

5. In an electrical connector assembly as claimed in claim 4 wherein, each of said probes, except for said conductive ends is coated with a polymer based upon poly-p-xylylene that is free of pin-holes and has a thickness of about 0.001 to 0.005 of an inch.

6. In an electrical connector assembly as claimed in claim 4 wherein, said coating comprising a vapor deposited pin hole-free coating of poly-monochloro-para-xylylyene.

7. In an electrical connection assembly, a male connector comprising probes that project from a first surface, with each having a conductive end, a female connector comprising a front surface having sockets with openings in said surface, said sockets each containing a conductive receptacle to receive the conductive ends of said probes for making electrical connections, each said socket, except for said conductive receptacle, being coated with a polymer based upon poly-p-xylylene, said coating being free of pin-holes and having a thickness of about 0.001 to 0.005 of an inch, connector means that move said first surface towards said front surface leaving a space therebetween and moving said probes into said sockets, and a resilient seal positioned in each of said socket openings for sealing said openings around said probes and protruding out from said front surface for sealing the outer surfaces of said probes in the space between said first surface and said front surface.

8. In an electrical connection assembly as claimed in claim 7 wherein, said front surface and said first surface having outer facing surfaces that encircle said openings and sockets, an o-ring seal compressed between said outer facing surfaces for enclosing and sealing the space between said enclosed front surface and first surface from the outer environment.

9. In an electrical connection assembly as claimed in claim 7 wherein, a fluid chamber positioned in said female connector for containing a dielectric fluid that communicates to said sockets.

10. In an electrical connection assembly as claimed in claim 9 wherein, pressure compensating means that equalizes the environmental pressure with the pressure of said dielectric fluid in said chamber.

11. In an electrical connection assembly as claimed in claim 10 wherein, said pressure compensating means comprising a flexible bladder position in said dielectric fluid chamber, and an opening through said front surface to said bladder.

12. In an electrical connection assembly as claimed in claim 10 wherein, said sockets comprising longitudinal conduits that extend in said chamber, and said conduits having an opening for passage of dielectric fluid from said chamber to said sockets.

13. In an electrical connection assembly as claimed in claim 10 wherein, said sockets comprising conduits having an opening through the conduits wall, a second flexible bladder enclosing the portion of said conduit having said opening for providing a flexible second fluid chamber inside said chamber, and said second bladder containing dielectric fluid.

14. In an electrical connector assembly as claimed in claim 9 wherein said coating comprises a vapor deposited coating of poly-monochloro-para-xylylyene.

15. In an electrical connector assembly, a connector receptacle having an exterior shell, a main dielectric filled chamber positioned in said shell with pressure compensating means that compensates the ambient exterior environment pressure with the pressure of the dielectric within said main chamber, a plurality of openings through said shell to the outside environment, a plurality of electrically conductive sockets disposed within in said main chamber, each in alignment with ones of said openings, movable pistons, each having an elongated tip, and electrical contact means disposed in each of said sockets, said pistons being movable to a first position where the tip extends into said openings and to a second position in which the tip is retracted from said openings exposing said electrical contact means, sealing means positioned in each of said openings for constricting the passage way into a sealing engagement with the elongated piston tip, each of said sockets having at least one ventilation hole allowing free flow of the main chamber dielectric fluid to every interior part of the sockets, and each of said sockets being coated with a thin film dielectric coating for forming an environmental and electrical barrier between the socket assembly and the fluid in the main chamber.

16. In a sealed electrical connector assembly, a receptacle having a receptacle shell, a fluid filled pressure compensating main chamber disposed within the receptacle shell, an end sealed assembly for sealably enclosing said main chamber and including a plurality of ports, a male conductor shell for receiving said receptacle shell, said male conductor shell has a probe face, a plurality of electrical male probes in said male conductor shell, each extending from said probe face and with an exposed conductive tip and a dielectric thin film coated shaft, each of said probes being insertable into the receptacle shell through a respective one of said ports, resilient seal means forming a seal of each probe in each of the ports, alignment means to align the probes with said ports, a plurality of electrical socket assemblies within the main chamber with electrical contacts, each of said socket assemblies being in alignment with a respective one of said ports and including a piston movably disposed in each electrical socket assembly with each piston having an elongate tip, each of said electrical socket assemblies being coated by a thin film insulating coating to insulate said socket assemblies from the fluid of the main chamber, the piston of each of the socket assemblies being movable by respective ones of the probes from a first position in which the elongate tip protrudes into and forms a seal with said resilient seal means in a respective ones of said ports to a second position in which said tip is retracted into the socket assembly, allowing the probe to make an electrical contact connection, and each of said resilient seal means having an elastomeric sealing extension protruding from said ports that press against the probe face from which each probe extends, creating a secondary seal between sealed electrical contacts and the outside environment.

* * * * *